US009930965B2

(12) United States Patent
Peterson

(10) Patent No.: US 9,930,965 B2
(45) Date of Patent: Apr. 3, 2018

(54) PADDLE BOARD BENCH

(71) Applicant: Greg Peterson, Hartland, WI (US)

(72) Inventor: Greg Peterson, Hartland, WI (US)

( * ) Notice: Subject to any disclaimer, the term of this patent is extended or adjusted under 35 U.S.C. 154(b) by 46 days.

(21) Appl. No.: 15/211,919

(22) Filed: Jul. 15, 2016

(65) Prior Publication Data

US 2018/0014649 A1 Jan. 18, 2018

(51) Int. Cl.

| | |
|---|---|
| ***A47C 11/00*** | (2006.01) |
| ***A47F 7/00*** | (2006.01) |
| ***A63B 71/00*** | (2006.01) |
| ***B63B 35/79*** | (2006.01) |
| ***A47C 4/03*** | (2006.01) |
| ***B63B 35/85*** | (2006.01) |
| ***A47B 81/00*** | (2006.01) |

(52) U.S. Cl.

CPC ..... *A47C 4/03* (2013.01); *A47B 81/00* (2013.01); *A47C 11/00* (2013.01); *A47F 7/0021* (2013.01); *A63B 71/0036* (2013.01); *B63B 35/79* (2013.01); *B63B 35/7946* (2013.01); *B63B 35/85* (2013.01)

(58) Field of Classification Search

CPC ..... B63B 35/7946; A47B 81/00; B60R 9/08; A47F 7/0021; A47F 7/0035; A63B 71/0036; A63C 11/028; A47C 11/00

See application file for complete search history.

(56) References Cited

U.S. PATENT DOCUMENTS

| | | | | |
|---|---|---|---|---|
| 1,542,770 A * | 6/1925 | Hess | A47C 11/00 297/352 |
| 2005/0082325 A1* | 4/2005 | Bourne | B60R 9/08 224/319 |
| 2012/0112029 A1* | 5/2012 | Wong | A63B 69/0022 248/346.5 |
| 2014/0129485 A1* | 5/2014 | Fisher | A47F 7/0035 705/500 |
| 2016/0106219 A1* | 4/2016 | Stirling | A47C 11/00 297/440.2 |

FOREIGN PATENT DOCUMENTS

DE 202014010014 U1 * 3/2015

OTHER PUBLICATIONS

Machine Translation of DE202014010014U1, Oct. 25, 2017; http://translationportal.epo.org/emtp/translate/?ACTION= description-retrieval&COUNTRY=DE&ENGINE=google&FORMAT=docdb&KIND=U1&LOCALE=en_EP&NUMBER=202014010014&OPS=ops.epo.org/3.2&SRCLANG=de&TRGLANG=en (Year: 2017).*

* cited by examiner

*Primary Examiner* — Ryan D Kwiecinski
(74) *Attorney, Agent, or Firm* — Michael Best & Friedrich LLP

(57) ABSTRACT

A paddle board bench supports a first paddle board and a second paddle board and includes a stand having a lower paddle board support portion arranged to support the first paddle board in a substantially horizontal position and an upper paddle board support portion arranged to support the second paddle board in a substantially vertical position. The first paddle board and the second paddle board are arranged to provide a seat for a user.

20 Claims, 3 Drawing Sheets

PADDLE BOARD BENCH

BACKGROUND

Paddle boarding has become a popular recreational activity on the water. Paddle boards are large boards that are stable when compared to smaller boards such as surf boards, wake boards, skis, and the like to allow a user to stand upright on the board while moving slowly or not moving at all. A long paddle is used to propel the user and the board through the water.

Due to their size and weight, paddle boards can be difficult to store and can take up excessive space in limited areas such as on small piers or on smaller shore lines.

BRIEF SUMMARY

In one construction, a paddle board bench supports a first paddle board and a second paddle board and includes a stand having a lower paddle board support portion arranged to support the first paddle board in a substantially horizontal position and an upper paddle board support portion arranged to support the second paddle board in a substantially vertical position. The first paddle board and the second paddle board are arranged to provide a seat for a user.

In another construction, a paddle board bench supports a first paddle board and a second paddle board and includes a first stand including a first lower slot and a first upper slot, and a second stand including a second lower slot and a second upper slot. The first lower slot and the second lower slot cooperate to support the first paddle board in a substantially horizontal position, and the first upper slot and the second upper slot cooperate to support the second paddle board in a substantially vertical position.

BRIEF DESCRIPTION OF THE DRAWINGS

To easily identify the discussion of any particular element or act, the most significant digit or digits in a reference number refer to the figure number in which that element is first introduced.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
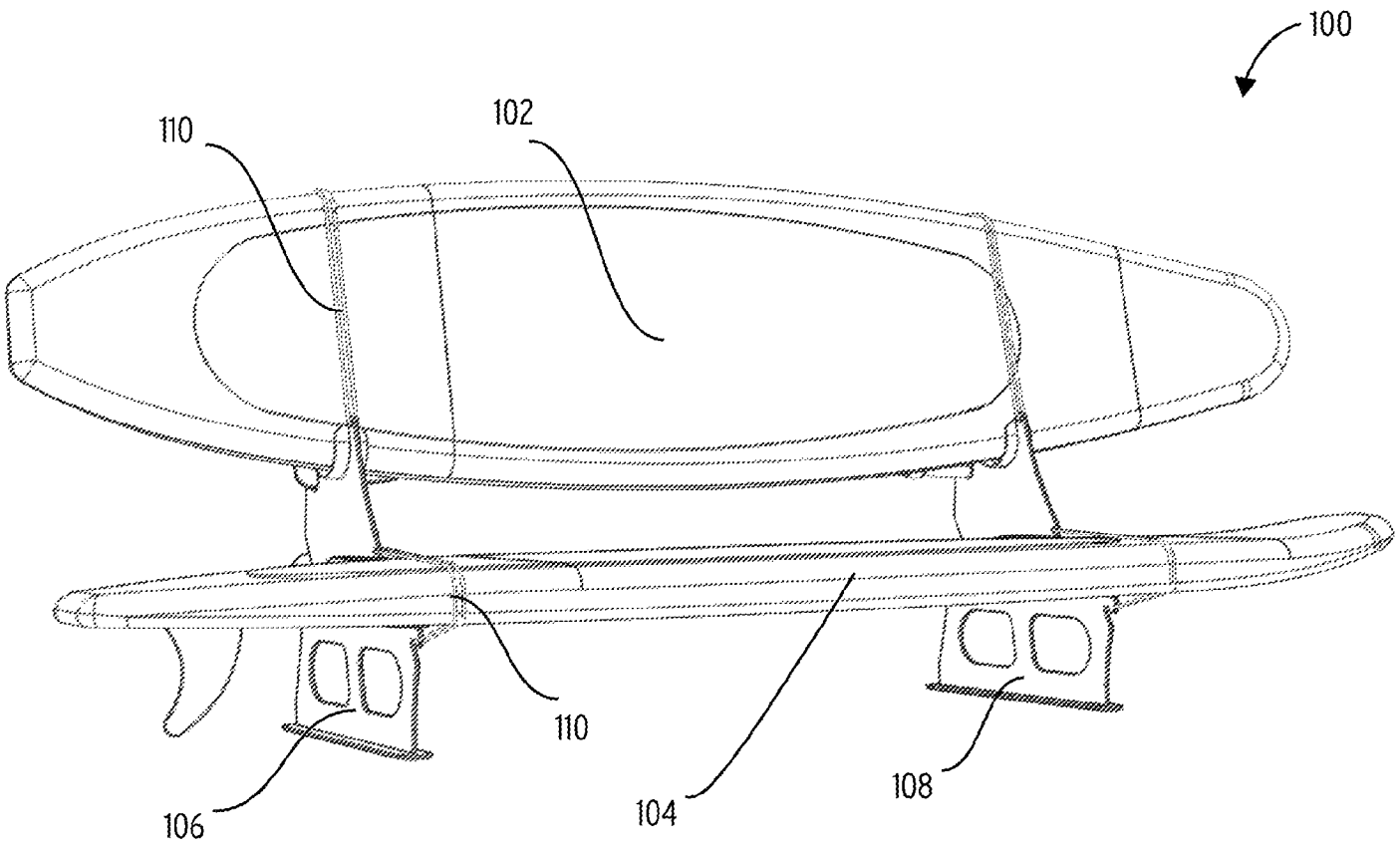
FIG. 1 is a perspective view of a paddle board bench.

FIG. 1 illustrates a paddle board bench 100 that includes a first stand 106 and a second stand 108 that are arranged to support a back paddle board 102 and a bottom paddle board 104 that are arranged to define a seat arranged for one or more users to sit upon. A plurality of tie down members 110 are arranged to inhibit the removal of the back paddle board 102 and the bottom back paddle board 102 from the first stand 106 and the second stand 108.

The back paddle board 102 and the bottom paddle board 104 are large and cumbersome objects that are difficult to store when not in use. By placing them in the first stand 106 and the second stand 108 they are conveniently stored, while also providing a space for users to sit.

Figure 2:
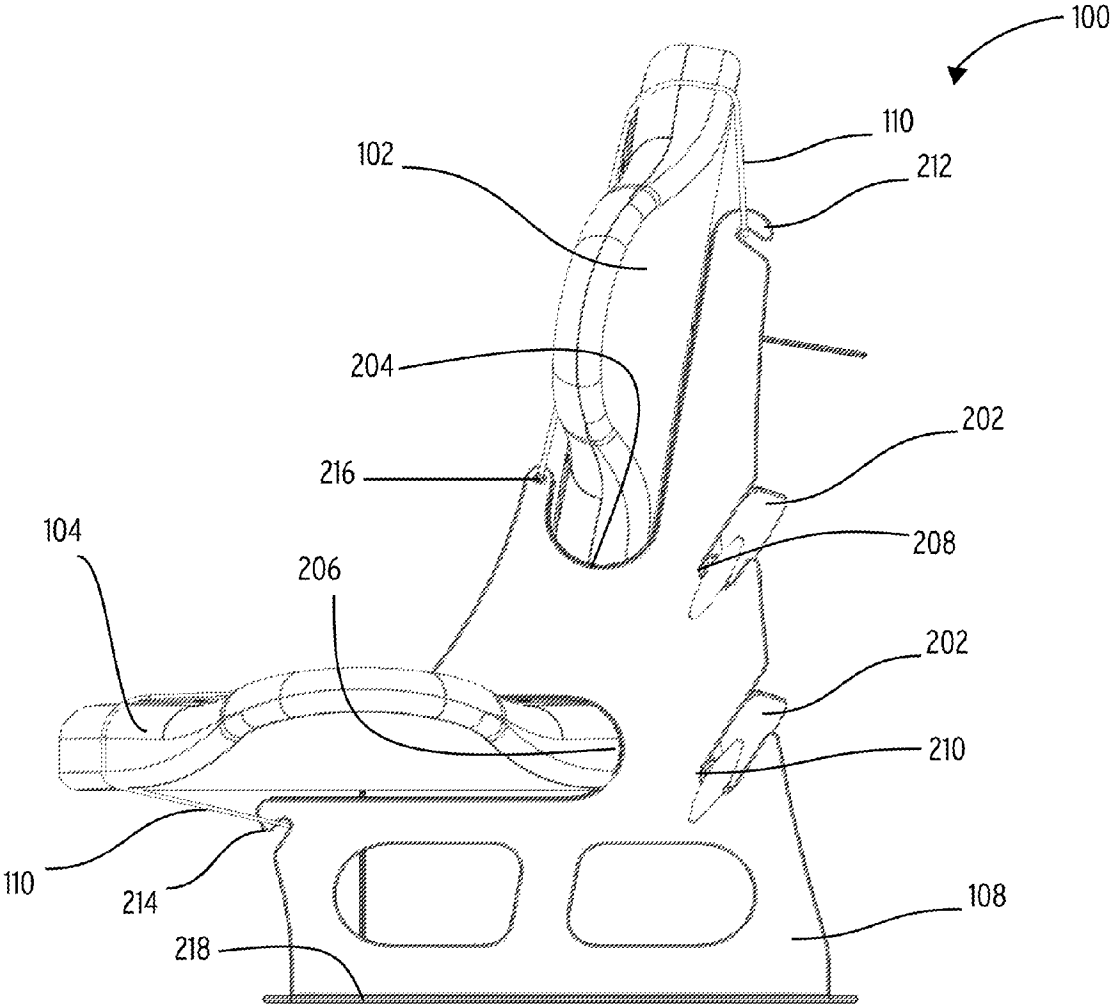
FIG. 2 is an end view of the paddle board bench of FIG. 1.

FIG. 2 is an end view of the paddle board bench 100 of FIG. 1 better illustrating the second stand 108. Before proceeding, it should be noted that the first stand 106 and the second stand 108 are similar components and only the second stand 108 will be described in detail.

The second stand 108 includes an upper slot 204 sized and arranged to receive the back paddle board 102 and to at least partially support the back paddle board 102 in a substantially vertical position (between 90 degrees and 120 degrees from horizontal). In the illustrated construction, the upper slot 204 is substantially U-shaped with a rear leg of the U-shape being longer than a front leg.

A lower slot 206 is arranged to receive the bottom paddle board 104 and support it in a substantially horizontal position (plus or minus 15 degrees). The lower slot 206 is substantially U-shaped and includes a lower leg of the U-shape that is longer than an upper leg.

An upper hook 212 and a lower hook 214 are formed as part of the second stand 108 and are shaped to selectively receive a first end of one of the tie down members 110. In the illustrated construction, each of the tie down members 110 include a rope-like component that may be elastic or substantially inelastic as may be desired. A second end of each of the tie down members 110 is fixedly attached to the second stand 108 at one of a first tie down attachment 216 and a second tie down attachment 306 (shown in FIG. 3). In the illustrated construction, the first tie down attachment 216 and the second tie down attachment 306 are apertures that receive the second ends of the tie down members to secure them to the second stand 108. In other constructions, the aperture may be replaced by a hook or other attachment arrangement to receive the second end of the tie down members 110.

With continued reference to FIG. 2, the second stand 108 includes a first paddle slot 208, and a second paddle slot 210 formed in the rear portion of the second stand 108. Each of the first paddle slot 208 and the second paddle slot 210 includes a U-shaped portion sized and arranged to receive a paddle 202 that is commonly used with a paddle board.

Each of the first stand 106 and the second stand 108 includes a stand attachment portion 218 arranged to attach to a pier or other surface to which the paddle board bench 100 is to be attached. A typical pier is made from wood or other materials that would allow for the use of bolts to attach the stand attachment portion 218 of each of the first stand 106 and the second stand 108. Of course, other means for attaching the first stand 106 and the second stand 108 could be employed.

Figure 3:
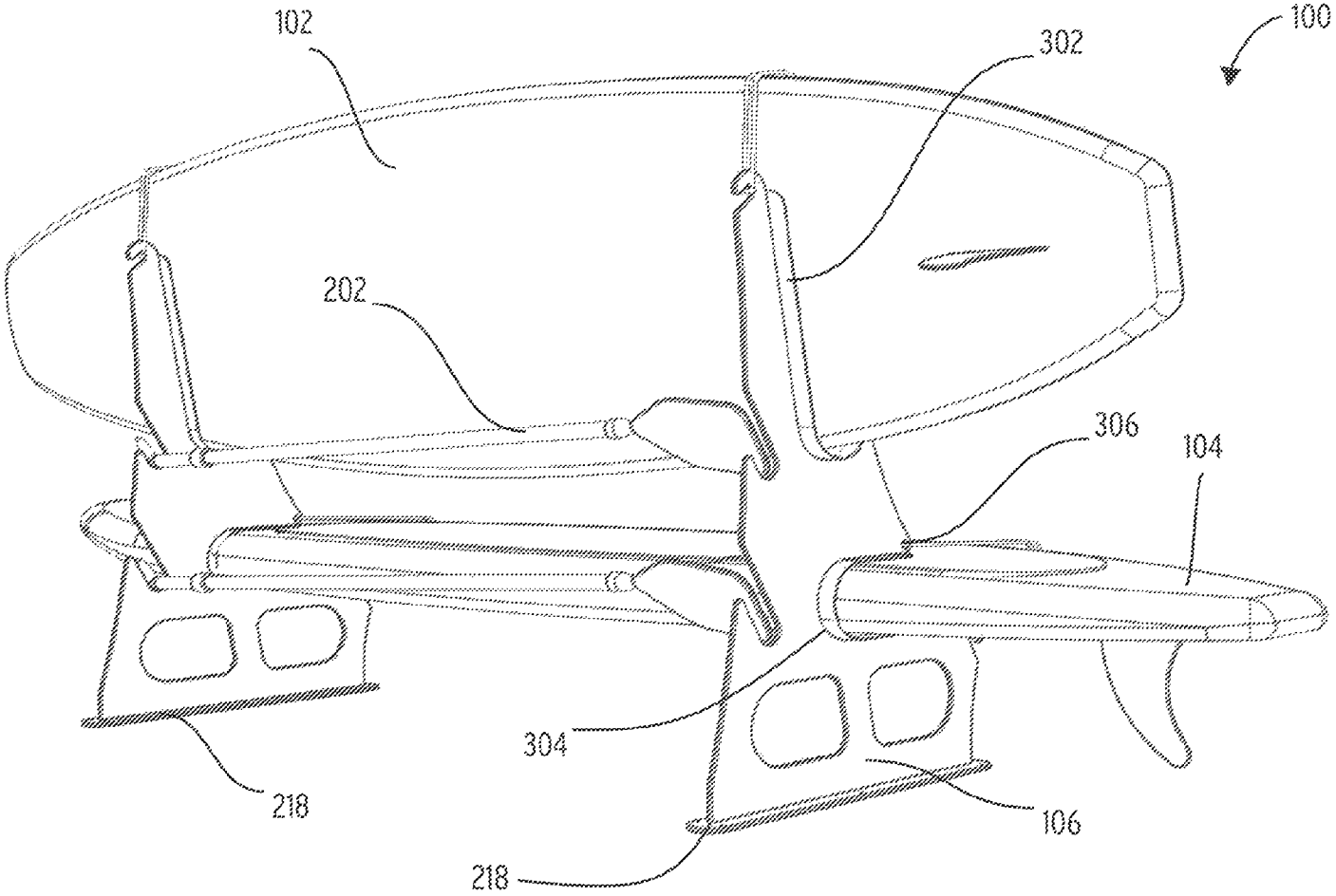
FIG. 3 is a rear perspective view of the paddle board bench of FIG. 1.

FIG. 3 is a rear perspective view of the paddle board bench 100 better illustrating an upper liner 302 and a lower liner 304. The upper liner 302 is preferably formed from a resilient or soft material that protects the surface of the back paddle board 102 when it is inserted in the upper slot 204. The upper liner 302 also takes up space to reduce movement of the back paddle board 102. In some constructions, the liners 302, 304 are formed as part of the first stand 106 and the second stand 108 to provide additional surface area for supporting the paddle boards 102, 104.

Similarly, the lower liner 304 is positioned in the lower slot 206 and functions in much the same manner as the upper liner 302.

In use, the first stand 106 and the second stand 108 are attached to the pier or to whatever structure the user desires to hold the paddle board bench 100. The upper liner 302 and the lower liner 304 are selected to provide the correct gap to receive the particular paddle boards being held. The bottom paddle board 104 is slid into the lower slot 206 of each of the first stand 106 and the second stand 108 to support the bottom paddle board 104. Tie down members 110 are wrapped around the bottom paddle board 104 and engaged with the lower hook 214 to secure the bottom paddle board 104. A similar process is followed with the back paddle board 102. First, the back paddle board 102 is positioned in the upper slot 204 of the first stand 106 and the second stand 108 to locate and support the back paddle board 102. Tie down members 110 are wrapped around the back paddle board 102 and engage the upper hook 212 of each of the first stand 106 and the second stand 108 to hold the back paddle board 102 in place.

The back paddle board 102 and the bottom paddle board 104 cooperate to define an angle that is between about 90 degrees and 120 degrees to allow users to sit on the bottom paddle board 104 while using the back paddle board 102 as a back rest like a common bench.

While the construction illustrated herein includes two stands, other constructions may include a single stand that supports the paddle boards as illustrated herein or could include a single stand that supports the paddle boards in a cantilever fashion.

Various features and advantages of the invention are set forth in the following claims.

What is claimed is:

1. A paddle board bench supporting a first paddle board and a second paddle board, the paddle board bench comprising:

a stand including a lower paddle board support portion having a slot arranged to support the first paddle board in a generally horizontal position and an upper paddle board support portion having a slot arranged to support the second paddle board in a generally vertical position, wherein the slot in the lower paddle board support portion and the slot in the upper paddle board support portion each have a respective liner positioned therein, and wherein the first paddle board and the second paddle board are arranged to provide a seat for a user.

2. The paddle board bench of claim 1, wherein the stand comprises a first stand and a second stand spaced apart from the first stand.

3. The paddle board bench of claim 1, wherein the stand comprises a first paddle slot arranged to receive a paddle board paddle.

4. The paddle board bench of claim 3, wherein the first paddle slot is located in the stand so as to be behind a user seated on the bench.

5. The paddle board bench of claim 1, wherein the first paddle board and the second paddle board cooperate to define an angle therebetween, and wherein the angle is between 90 degrees and 120 degrees.

6. The paddle board bench of claim 1, further comprising a plurality of tie down members each arranged to inhibit removal of one of the first paddle board and the second paddle board.

7. The paddle board bench of claim 1, wherein each liner is formed from a resilient material.

8. The paddle board bench of claim 1, wherein each liner is formed as part of the stand.

9. The paddle board bench of claim 1, wherein each slot is U-shaped, with a leg of the U-shaped slot being longer than another leg of the U-shaped slot.

10. The paddle board bench of claim 1, wherein the stand includes an attachment portion to attach the stand to a support surface.

11. A paddle board bench supporting a first paddle board and a second paddle board, the paddle board bench comprising:

a first stand including a first lower slot and a first upper slot;

a second stand including a second lower slot and a second upper slot, wherein the first lower slot and the second lower slot cooperate to support the first paddle board in a generally horizontal position, and the first upper slot and the second upper slot cooperate to support the second paddle board in a generally vertical position, wherein the first paddle board and the second paddle board are arranged to provide a seat for a user; and a plurality of liners, one of the plurality of liners disposed in each of the first lower slot, the first upper slot, the second lower slot, and the second upper slot.

12. The paddle board bench of claim 11, further comprising a plurality of tie down members, each of the tie down members including a first end selectively attachable to one of the first stand and the second stand to inhibit the removal of one of the first paddle board and the second paddle board.

13. The paddle board bench of claim 11, wherein each of the plurality of liners is formed from a resilient material.

14. The paddle board bench of claim 11, wherein the first paddle board and the second paddle board cooperate to define an angle therebetween, and wherein the angle is between 90 degrees and 120 degrees.

15. The paddle board bench of claim 11, wherein each of the plurality of liners is formed as part of the stand.

16. The paddle board bench of claim 11, wherein each slot is U-shaped, with a leg of the U-shaped slot being longer than another leg of the U-shaped slot.

17. The paddle board bench of claim 11, wherein each of the first and second stands includes an attachment portion to attach the stand to a support surface.

18. The paddle board bench of claim 11, wherein each of the first and second stands includes a first paddle slot arranged to receive and together support a paddle board paddle.

19. The paddle board bench of claim 18, wherein the first paddle slot is located in the first and second stands so as to be behind a user seated on the bench.

20. A paddle board bench supporting a first paddle board and a second paddle board, the paddle board bench comprising:

a first stand including a first U-shaped lower slot and a first U-shaped upper slot;

a second stand including a second U-shaped lower slot and a second U-shaped upper slot, wherein the first U-shaped lower slot and the second U-shaped lower slot cooperate to support the first paddle board in a generally horizontal position, and the first U-shaped upper slot and the second U-shaped upper slot cooperate to support the second paddle board in a generally vertical position, wherein the first paddle board and the second paddle board cooperate to define an angle therebetween of between 90 degrees and 120 degrees so as to provide a seat for a user;

a plurality of liners, one of the plurality of liners disposed in each of the first lower U-shaped slot, the first upper U-shaped slot, the second lower U-shaped slot, and the second upper U-shaped slot;

at least one tie down member arranged to inhibit removal of the first paddle board from within at least one of the first and second U-shaped lower slots; and at least one tie down member arranged to inhibit removal of the second paddle board from within at least one of the first and second U-shaped upper slots.

* * * * *